US010350889B2

(12) United States Patent
Irokawa

(10) Patent No.: US 10,350,889 B2
(45) Date of Patent: Jul. 16, 2019

(54) LIQUID JET HEAD INCLUDING AN ACTUATOR FOR PERFORMING A DISPLACING OPERATION

(71) Applicant: SII Printek Inc., Chiba-shi, Chiba (JP)

(72) Inventor: Daiki Irokawa, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 15/855,138

(22) Filed: Dec. 27, 2017

(65) Prior Publication Data

US 2018/0178515 A1 Jun. 28, 2018

(30) Foreign Application Priority Data

Dec. 28, 2016 (JP) ..... 2016-255172

(51) Int. Cl.
*B41J 2/14* (2006.01)
*B41J 2/045* (2006.01)

(52) U.S. Cl.
CPC ..... *B41J 2/14201* (2013.01); *B41J 2/04516* (2013.01); *B41J 2/04581* (2013.01); *B41J 2/04588* (2013.01); *B41J 2/14209* (2013.01); *B41J 2002/14338* (2013.01); *B41J 2202/05* (2013.01)

(58) Field of Classification Search
CPC ..... B41J 2/04516; B41J 2/04581; B41J 2/04588; B41J 2/14209
See application file for complete search history.

(56) References Cited

U.S. PATENT DOCUMENTS

2006/0092239 A1* 5/2006 Sung ..... B41J 2/09 347/71
2007/0058010 A1 3/2007 Nagashima
2009/0128603 A1 5/2009 Drury

FOREIGN PATENT DOCUMENTS

JP 5047958 B2 10/2012

OTHER PUBLICATIONS

Extended European Search Report in European Application No. 17208439.4, dated Jun. 12, 2018, pp. 1-7.

* cited by examiner

*Primary Examiner* — Juanita D Jackson
(74) *Attorney, Agent, or Firm* — Brinks Gilson & Lione

(57) ABSTRACT

There are provided a liquid jet head and a liquid jet recording device each capable of appropriately cutting off the liquid column formed immediately after being jetted from the jet hole to prevent the satellite droplet from generating, and further achieving easier maintenance of the jet hole part. The liquid jet head includes a drive actuator, a jet hole plate, and a flow channel operating actuator. The drive actuator applies a pressure variation to a liquid filled therein. The jet hole plate is disposed on a downstream side of the drive actuator and adapted to jet the liquid having flown out from the drive actuator from the jet hole to the outside of the drive actuator. The flow channel operating actuator is disposed between the drive actuator and the jet hole plate, provided with a communication section adapted to communicate the drive actuator and the jet hole with each other, and has a configuration capable of performing a displacing operation on at least a part of the peripheral edge part of the communication section.

7 Claims, 9 Drawing Sheets

32 (5)
48
49
55
57
60
64
65
66
67
76
54
I
Ia
X
Y
Z

LIQUID JET HEAD INCLUDING AN ACTUATOR FOR PERFORMING A DISPLACING OPERATION

RELATED APPLICATIONS

This application claims priority under 35 U.S.C. § 119 to Japanese Patent Application No. 2016-255172 filed on Dec. 28, 2016, the entire content of which is hereby incorporated by reference.

BACKGROUND OF THE INVENTION

Field of the Invention

The present invention relates to a liquid jet head and a liquid jet recording device.

Background Art

There exists an inkjet printer equipped with an inkjet head as a device for ejecting ink (liquid) in a droplet state to a recording target medium (e.g., recording paper) to thereby record information (e.g., images and characters) on the recording target medium.

The inkjet head described above has an actuator block and a nozzle plate (a jet hole plate), wherein the actuator block is provided with a drive actuator for applying a fluid pressure variation to the ink having fed from a pump, and the nozzle plate is bonded to the actuator block and has jet holes communicated with the drive actuator. In the inkjet head, the ink is jetted outside through the jet holes due to the application of the pressure variation by the drive actuator.

In the case of the inkjet head of this type, the ink jetted from the jet hole forms an ink column (liquid column) having a columnar shape, and then forms an ink droplet having a predetermined volume due to the surface tension, and then lands on the recording target medium.

However, depending on the viscosity of the ink to be used, and the jet speed of the ink, the length of the ink column actually formed when being jetted from the jet hole is elongated, and a part of the ink column is separated from a main droplet and scattered around as a satellite droplet. In this case, the satellite droplet adheres to the nozzle plate or the recording target medium, and is apt to cause dirt on the nozzle plate and deterioration of the print image quality.

As the inkjet head for dealing with the above, there have been worked out an inkjet head in which it is arranged that a gas is jetted to the outside of the jet hole of the nozzle plate from a direction perpendicular to the jet direction to thereby cut off the ink column (see, e.g., Japanese Patent No. 5,047,958), an inkjet head in which it is arranged that an ultrasonic application device is disposed outside the jet hole of the nozzle plate to cut off the ink column with an ultrasonic wave, and so on.

However, in the inkjet heads described above, since a mechanism for cutting off the ink liquid column is disposed outside the jet hole, the jet hole itself is located at the position recessed from the end surface of the inkjet head, and the maintenance of the jet hole part for keeping an appropriate print quality becomes hard.

Therefore, the invention is for providing a liquid jet head and a liquid jet recording device each capable of appropriately cutting off the liquid column formed immediately after being jetted from the jet hole to prevent the satellite droplet from generating, and further achieving easier maintenance of the jet hole part.

SUMMARY OF THE INVENTION

In order to solve the problems described above, in a liquid jet head according to an aspect of the invention, there are included a drive actuator adapted to apply a pressure variation to a liquid filled therein, a jet hole plate disposed on a downstream side of the drive actuator and adapted to jet the liquid having flown out from the drive actuator from a jet hole to an outside, and a flow channel operating actuator disposed between the drive actuator and the jet hole plate, provided with a communication section adapted to communicate the drive actuator and the jet hole with each other, and configured to perform a displacing operation on at least a part of a peripheral edge part of the communication section.

According to this configuration, when the fluid pressure variation is applied by the drive actuator to the liquid, the liquid is fed to the jet hole of the jet hole plate passing through the communication section of the flow channel operating actuator. Subsequently, when the flow channel operating actuator is driven, the displacing operation is performed on the peripheral edge part of the communication section. At this moment, by the peripheral edge part of the communication section being displaced before the liquid to be jetted from the jet hole forms the long liquid column between the liquid to be jetted and the liquid remaining in the jet hole, the back part of the liquid column of the liquid thus jetted is cut off. As a result, the liquid thus jetted is prevented from forming a satellite droplet.

It should be noted that by displacing a part of the peripheral edge of the communication section in an appropriate direction when the liquid is fed to the jet hole of the jet hole plate passing through the communication section of the flow channel operating actuator, it is possible to change the jet direction of the liquid to be jetted from the jet hole of the jet hole plate to a desired direction.

Further, according to the configuration described above, since the flow channel operating actuator is disposed on the inner side of the jet hole of the jet hole plate, it is possible to easily and surely wipe the outer peripheral edge part of the jet hole with a blade or the like during maintenance. Therefore, it is possible to form an appropriate meniscus inside the jet hole.

It is also possible for the flow channel operating actuator to be configured to perform a displacing operation on the peripheral edge part of the communication section in a direction substantially perpendicular to an axial direction toward the jet hole of the communication section.

In this case, when the peripheral edge part of the communication section is displaced in a direction substantially perpendicular to the axial direction due to the operation of the flow channel operating actuator, by, for example, thinning the inner diameter of the communication section when the liquid is jetted from the jet hole to start forming the liquid column, the back part of the liquid column is cut off by the movement of the communication section.

It is also possible for the flow channel operating actuator to be configured to perform a displacing operation on the peripheral edge part of the communication section in a direction along an axial direction toward the jet hole of the communication section.

In this case, when the peripheral edge part of the communication section is displaced in a direction along the axial direction due to the operation of the flow channel operating actuator, by, for example, the peripheral edge part of the communication section moving in a direction opposite to the jet direction of the liquid when the liquid is jetted from the jet hole to start forming the liquid column, the back part of the liquid column is cut off by the movement of the communication section.

It is also possible for the jet hole plate to be bonded to the flow channel operating actuator so that a peripheral edge part of the jet hole follows a displacement of the peripheral edge part of the communication section.

In this case, when the peripheral edge part of the communication section is displaced due to the operation of the flow channel operating actuator, the peripheral edge part of the jet hole is similarly displaced following the displacement. Therefore, in the early stage in which the liquid jetted from the jet hole starts forming the liquid column, the back part of the liquid column is cut off due to the displacement of the peripheral edge part of the jet hole.

It is also possible to further provide a control section adapted to control drive of the drive actuator and the flow channel operating actuator, and the control section can drive the flow channel operating actuator at a timing when the liquid bulges from the jet hole of the jet hole plate due to the drive of the drive actuator.

In this case, since the peripheral edge part of the communication section is displaced due to the flow channel operating actuator at the timing when the liquid bulges from the jet hole of the jet hole plate when jetting the liquid, it results that the back part of the liquid column is appropriately cut off in an early stage in which the liquid having been jetted from the jet hole starts forming the liquid column.

It is also possible for the flow channel operating actuator to be configured by bonding electrodes opposite to each other to both sides of a plate-shaped piezoelectric material, and it is also possible for the communication section to be formed so as to penetrate the piezoelectric material in a plate thickness direction.

In this case, since the flow channel operating actuator is formed to be thin in wall thickness, it becomes possible to compactly dispose the flow channel operating actuator between the drive actuator and the jet hole plate. Therefore, by adopting this configuration, it is possible to achieve miniaturization of the liquid jet head.

A liquid jet recording device according to another aspect of the invention is provided with the liquid jet head according to any one of the aspects of the invention described above.

According to the liquid jet recording device of this aspect of the invention, since the liquid jet head according to any one of the aspects described above is provided, it is possible to jet the liquid to the recording target medium with high quality, and at the same time, the maintenance also becomes easy.

According to this aspect of the invention, it is possible to appropriately cut off the liquid column formed immediately after being jetted from the jet hole to prevent the satellite droplet from generating, and further achieve easier maintenance of the jet hole part.

DETAILED DESCRIPTION OF THE INVENTION

Figure 1:
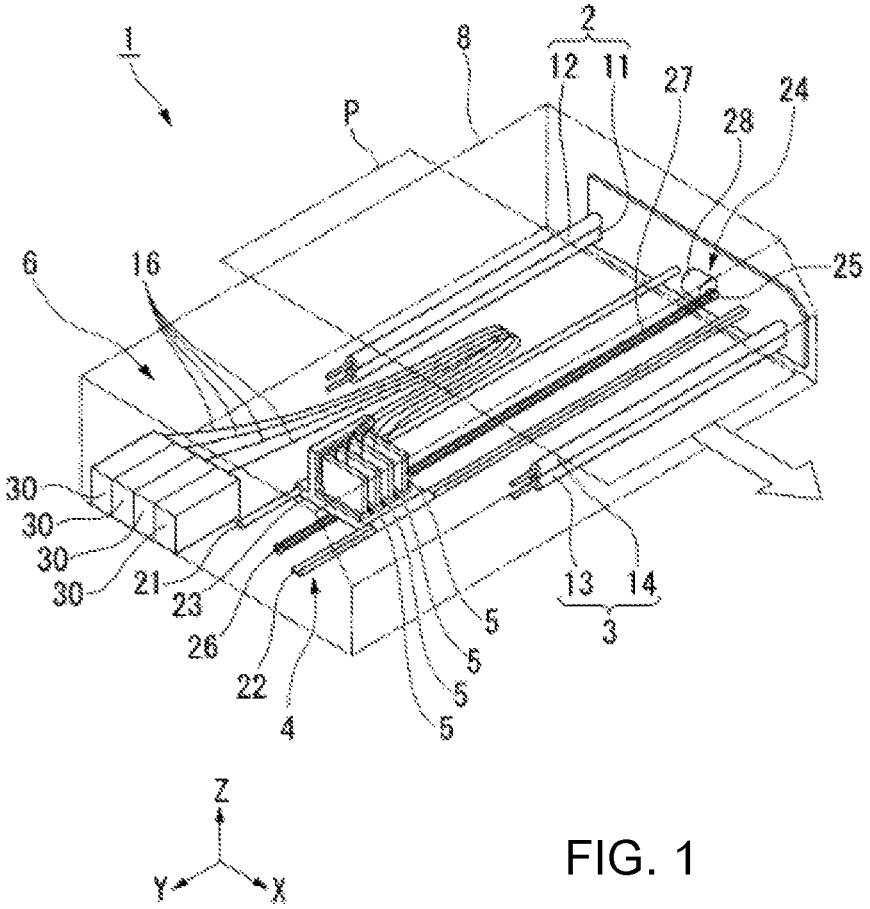
FIG. 1 is a schematic configuration diagram of a liquid jet recording device (an inkjet printer) according to an embodiment.

Some embodiments according to the invention will hereinafter be described with reference to the accompanying drawings. In the following embodiments, the description will be presented citing an inkjet printer 1 (hereinafter simply referred to as a printer), which is a liquid jet recording device for performing recording on a recording target medium using ink (liquid), as an example. It should be noted that the scale size of each member is accordingly altered so as to provide a recognizable size in the drawings used in the following description.

[Printer]

FIG. 1 is a schematic configuration diagram of the printer 1 according to the embodiment.

As shown in FIG. 1, the printer 1 according to the present embodiment is constituted by a pair of conveying mechanisms 2, 3, a scanning mechanism 4, an inkjet head 5 as a liquid jet head, an ink supply mechanism 6, and so on mounted on a housing 8.

It should be noted that in the following explanation, the description is presented using a Cartesian coordinate system of X, Y, and Z as needed. In this case, the X direction coincides with the conveying direction of the recording target medium P (e.g., paper). The Y direction coincides with the scanning direction of the scanning mechanism 4. The Z direction is a direction perpendicular to the X direction and the Y direction. In the following explanation, the description will be presented defining the arrow direction as the positive (+) direction, and a direction opposite to the arrow direction as the negative (−) direction in the drawings out of the X direction, Y direction, and the Z direction.

The conveying mechanisms 2, 3 convey the recording target medium P in the X direction. Specifically, the conveying mechanism 2 is provided with a grit roller 11 extending in the Y direction, a pinch roller 12 extending in parallel to the grit roller 11, and a drive mechanism (not shown) such as a motor for making axial rotation of the grit roller 11. The conveying mechanism 3 is provided with a grit roller 13 extending in the Y direction, a pinch roller 14 extending in parallel to the grit roller 13, and a drive mechanism (not shown) for making axial rotation of the grit roller 13.

The scanning mechanism 4 reciprocates the inkjet heads 5 in the Y direction. Specifically, the scanning mechanism 4 is provided with a pair of guide rails 21, 22, a carriage 23, and a drive mechanism 24, wherein the pair of guide rails 21, 22 extend in the Y direction, the carriage 23 is movably supported by the pair of guide rails 21, 22, and the drive mechanism 24 moves the carriage 23 in the Y direction.

The drive mechanism 24 is disposed between the guide rails 21, 22 in the X direction. The drive mechanism 24 is provided with a pair of pulleys 25, 26, an endless belt 27, and a drive motor 28, wherein the pair of pulleys 25, 26 are disposed in the Y direction with a distance, the endless belt 27 is wound between the pair of pulleys 25, 26, and the drive motor 28 rotationally drives the pulley 25 as one of the pulleys 25, 26.

The carriage 23 is connected to the endless belt 27. On the carriage 23, there is mounted the plurality of inkjet heads 5 in the state of being arranged in the Y direction.

The inkjet heads 5 are configured so as to be able to eject ink of respective colors different from each other such as yellow, magenta, cyan, and black.

The ink supply mechanism 6 is provided with ink tanks 30 each housing the ink, and ink pipes 16 for respectively connecting the ink tanks 30 and the inkjet heads 5 to each other.

The ink tanks 30 are disposed separately from the inkjet heads 5 (the carriage 23) in the housing 8. The plurality of ink tanks 30 is arranged side by side in the X direction in the housing 8. In the ink tanks 30, there are housed the inks of the respective colors different from each other so as to correspond to the inkjet heads 5 described above.

The ink pipes 16 are each, for example, a flexible hose having flexibility. The ink pipes 16 are made to be able to follow the inkjet heads 5, respectively.

[Inkjet Head]

Figure 2:
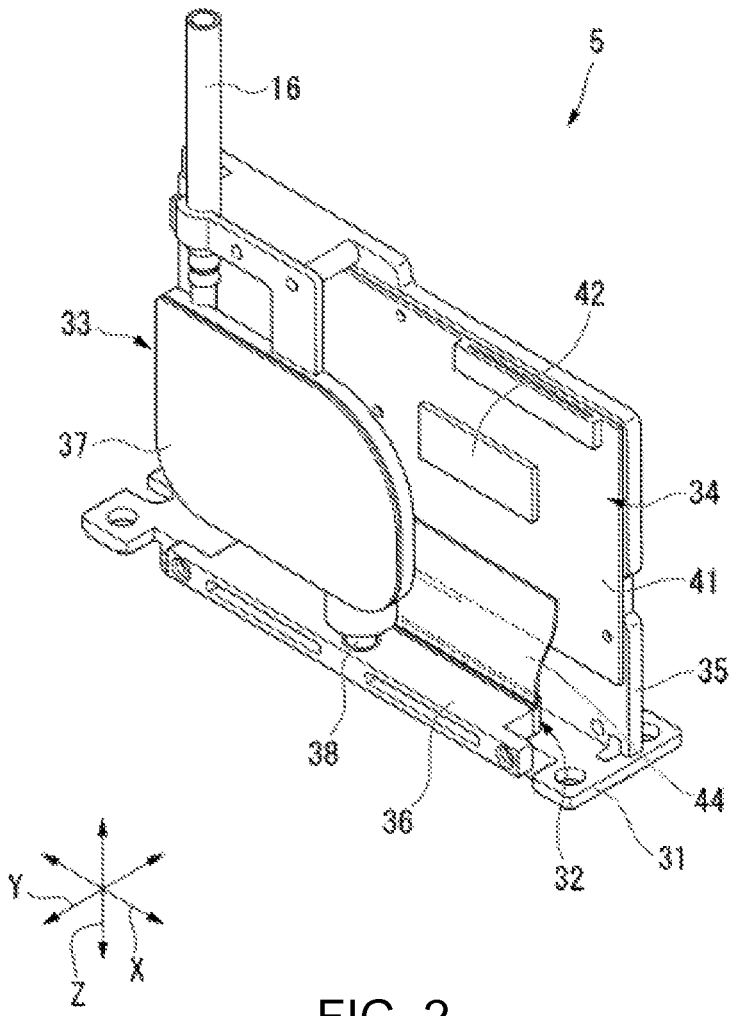
FIG. 2 is a perspective view of a liquid jet head (an inkjet head) according to the embodiment.

FIG. 2 is a perspective view of the inkjet head 5.

As shown in FIG. 2, the inkjet head 5 is provided with a fixation plate 31, a head chip 32, an ink supply section 33, and a control section 34, wherein the fixation plate 31 is fixed to the carriage 23, the head chip 32 is fixed on the fixation plate 31, the ink supply section 33 supplies the head chip 32 with the ink having been supplied from the ink supply mechanism 6 via a pump for ink supply not shown, and the control section 34 applies a drive voltage to the head chip 32.

To the fixation plate 31, there is fixed the base plate 35 in the state of standing up in the Z direction.

The ink supply section 33 is mainly provided with a flow channel member 36, a pressure damper 37, and an ink connection pipe 38, wherein the flow channel member 36 is fixed to the fixation plate 31, the pressure damper 37 is fixed to the base plate 35, and the ink connection pipe 38 connects the flow channel member 36 and the pressure damper 37 to each other.

To the pressure damper 37, there is connected the ink pipe 16 shown in FIG. 1. When the ink is supplied to the pressure damper 37 via the ink supply pipe 16, the pressure damper 37 once reserves the ink inside. Further, the pressure damper 37 supplies the ink thus reserved to the head chip 32 via the ink connection pipe 38 and the flow channel member 36.

The control section 34 has an IC board 41 fixed to the base plate 35, and a control circuit 42 is mounted on the IC board 41. The control circuit 42 has an integrated circuit for driving the head chip 32, and so on. The control circuit 42 is electrically connected to the head chip 32 via a flexible printed board 44 on which a wiring pattern not shown is printed.

[Head Chip]

Figure 3:
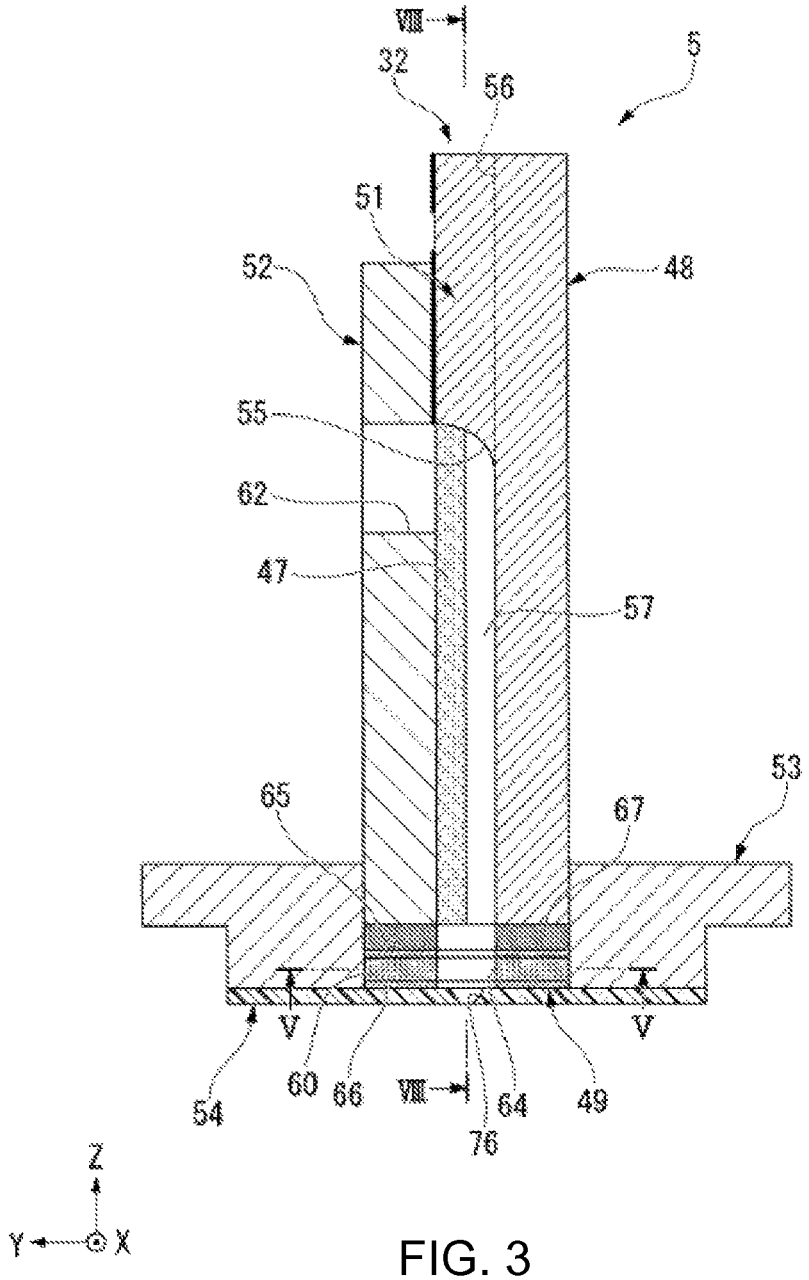
FIG. 3 is a cross-sectional view of a head chip to be mounted on the liquid jet head (the inkjet head) according to the embodiment.

FIG. 3 is a perspective view of the head chip 32.

The head chip 32 is of a so-called edge-shoot type for ejecting the ink from an end part in the extending direction (the Z-direction) of an ejection channel 55 described later. Specifically, the head chip 32 is provided with a first actuator plate 51, a cover plate 52, second actuator plates 60, a support plate 53, and a nozzle plate (a jet hole plate) 54, wherein the first actuator plate 51 constitutes a drive actuator 48, the cover plate 52 covers the surface of the first actuator plate 51, the second actuator plates 60 each constitute a flow channel operating actuator 49, the support plate 53 supports the first actuator plate 51, the cover plate 52, and the second actuator plates 60, and the nozzle plate 54 has jet holes 76.

In the following explanation, the description will be presented defining the cover plate 52 side in the Y direction as an obverse side, and the first actuator plate 51 side as a reverse side. Further, the description will be presented defining the nozzle plate 54 side in the Z direction as a lower side, and the opposite side to the nozzle plate 54 as an upper side.

Figure 4:
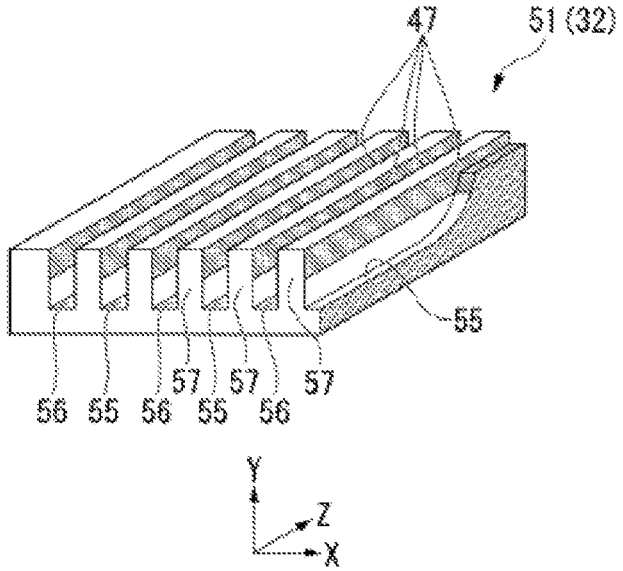
FIG. 4 is a partial cross-sectional perspective view of the head chip of the liquid jet head (the inkjet head) according to the embodiment.

FIG. 4 is a partial cross-sectional perspective view of a part (the first actuator plate 51) of the head chip 32.

The first actuator plate 51 is a so-called monopole substrate, the polarization direction of which is set to one direction along the thickness direction (the Y direction). It should be noted that as the first actuator plate 51, there is preferably used piezoelectric ceramics formed of, for example, PZT (lead zirconate titanate). It should be noted that the first actuator plate 51 can also be formed by stacking two piezoelectric substrates different in polarization direction in the Z direction on one another (a so-called chevron type).

On the surface of the first actuator plate 51, there is disposed a plurality of channels 55, 56 with a distance in the X direction. The channels 55, 56 are each formed linearly along the Z direction. Therefore, each of the channels 55, 56 is partitioned by a drive wall 57 formed of the first actuator plate 51 in the X direction.

The plurality of channels 55, 56 includes ejection channels 55 filled with the ink, and non-ejection channels 56 not filled with the ink. The ejection channels 55 and the non-ejection channels 56 are alternately arranged along the X direction. It should be noted that electrodes 47 for driving are formed respectively on the inner surfaces (the drive walls 57) of the ejection channels 55 and the non-ejection channels 56. The drive voltage is applied to the electrodes 47 via the flexible printed board 44 described above, and thus, the electrodes 47 deform the drive walls 57 due to the piezoelectric shear effect.

The cover plate 52 is formed so as to have a rectangular shape in a planar view viewed from the Y direction. The cover plate 52 is bonded to the surface of the first actuator plate 51 in a state in which the upper end part of the first actuator plate 51 is exposed. The cover plate 52 has a plurality of ink introduction grooves 62 respectively communicated with the ejection channels 55 of the first actuator plate 51. It should be noted that the ink introduction grooves 62 are not communicated with the non-ejection channels 56 adjacent to the respective ejection channels 55.

In the ejection channel 55 of the first actuator plate 51, when a voltage having a rectangular shape is applied between the electrodes 47 located across the drive wall 57 due to the control by the control section 34, the drive walls 57 opposed to each other deform to thereby increase or decrease the capacity. On this occasion, the ejection channel 55 performs a filling operation and an extruding operation of a predetermined amount of ink. The ejection channels 55 and the electrodes 47 of the first actuator plate 51 constitute a principal part of the drive actuator 48 for applying varying pressure to the liquid (ink) in accordance with the drive voltage. It should be noted that the operation of each of the ejection channels 55 is individually controlled in response to a drive signal from the control section 34.

The second actuator plates 60 are each formed of, for example, a thin-wall monopole substrate, the polarization direction of which is set to one direction along the thickness direction. The second actuator plate 60 is disposed on the −Z direction side of each of the ejection channels 55 of the first actuator plate 51 so that the thickness direction coincides with the Z direction. As the second actuator plate 60, there is preferably used piezoelectric ceramics formed of, for example, PZT (lead zirconate titanate).

The nozzle plate 54 is disposed on the −Z direction side of the second actuator plates 60 so that the thickness direction coincides with the Z direction. The second actuator plate 60 has a communication hole 64 which is a communication section for communicating the ejection channel 55 of the first actuator plate 51 and corresponding one of the jet holes 76 of the nozzle plate 54 with each other. The communication hole 64 is formed so as to penetrate the second actuator plate 60 in the thickness direction.

Figure 5:
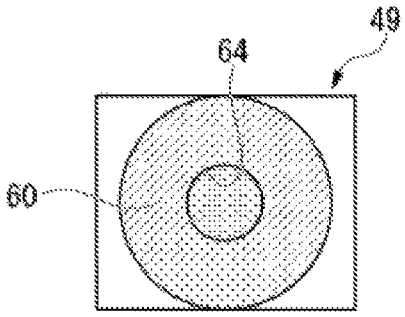
FIG. 5 is a cross-sectional view along the V-V line in FIG. 3 of the liquid jet head (the inkjet head) according to the embodiment.

FIG. 5 is a cross-sectional view along the V-V line shown in FIG. 3.

Figure 6:
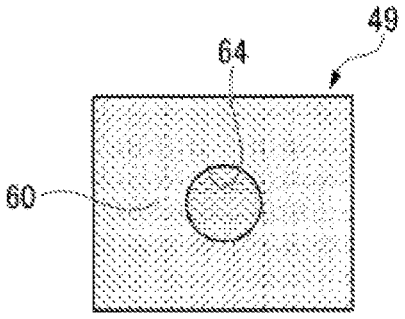
FIG. 6 is a cross-sectional view similar to FIG. 5 of a modified example of the liquid jet head (the inkjet head) according to the embodiment.

In the case of the present embodiment, the second actuator plate 60 is formed to have a substantially circular shape viewed from the Z direction as shown in FIG. 5, and the communication hole 64 is formed to have a circular shape at a substantially central position of the second actuator plate 60. It should be noted that the shape of the second actuator plate 60 is not limited to this shape, but can also be other shapes such as a rectangular shape viewed from the Z direction as in the case of the modified example shown in FIG. 6.

Here, assuming that the nozzle plate 54 side out of the second actuator plate 60 is referred to as an obverse side, and the first actuator plate 51 side is referred to as a reverse side, the electrodes 65, 66 for driving are bonded to each of the obverse side and the reverse side of the second actuator plate 60 using evaporation or the like. To these electrodes 65, 66 for driving, there is input the pulsed drive voltage due to the control by the control section 34. In the second actuator plate 60, when the voltage in one direction is input to the electrodes 65, 66, the outer peripheral edge part of the communication hole 64 deforms to be flattened in the thickness direction, and at the same time, a part of the inner peripheral edge part of the communication hole 64 deforms so as to bulge toward the center of the communication hole 64. Each of the second actuator plates 60 and the electrodes 65, 66 constitute a principal part of the flow channel operating actuator 49 for performing a displacing operation on the peripheral edge part of the communication hole 64 using the drive voltage. The flow channel operating actuator 49 is individually disposed for each of the ejection channels 55.

Further, between the second actuator plate 60 and the first actuator plate 51, there is disposed an insulating plate 67 made of ceramics or the like for electrically isolating between the both constituents. When manufacturing the flow channel operating actuator 49, for example, it is also possible to form the electrode 65, the second actuator plate 60 (the piezoelectric ceramics), the electrode 66 of the obverse surface side of the insulating plate 67 in sequence with evaporation, and then provide a through hole including the communication hole 64 to these constituents with a blast process or the like.

Further, the insulating plate 67 integrated with each of the flow channel operating actuators 49 is bonded to an end surface in the −Z direction of the first actuator plate 51.

The outer peripheral part of each of the first actuator plate 51 and the cover plate 52 is fitted and fixed to the support plate 53, and at the same time, the nozzle plate 54 is attached to the end surface on the −Z direction side of the support plate 53.

The nozzle plate 54 is provided with a plurality of jet holes 76 so as to correspond to the respective ejection channels 55 of the first actuator plate 51. Each of the jet holes 76 is communicated with corresponding one of the ejection channels 55 of the first actuator plate 51 via the communication hole 64 of the second actuator plate 60. Further, the nozzle plate 54 is bonded to the outer peripheral edge part of the corresponding communication hole 64 of the second actuator plate 60 in at least the outer peripheral edge part of each of the jet holes 76.

[Operation Method of Printer]

Then, a method of recording information on the recording target medium P using the printer 1 described above will be described.

As shown in FIG. 1, when operating the printer 1, the grit rollers 11, 13 of the conveying mechanisms 2, 3 rotate to thereby convey the recording target medium P between the grit rollers 11, 13 and the pinch rollers 12, 14 in the X direction. Further, at the same time as this operation, the drive motor 28 rotates the pulleys 26 to run the endless belt 27. Thus, the carriage 23 reciprocates in the Y direction while being guided by the guide rails 21, 22.

Meanwhile, in each of the inkjet heads 5, the drive voltage is applied to the electrode 47 of the predetermined drive actuator 48 (the ejection channel 55) of the head chip 32. Thus, the thickness shear deformation is caused in the drive wall 57, and thus, the pressure wave is generated in the ink filling the ejection channel 55. Due to the pressure wave, the internal pressure of the ejection channel 55 increases, and the ink passes through the communication hole 64 of the flow channel operating actuator 49 and the jet hole 76 of the nozzle plate 54, and is then jetted outside. Further, when the ink lands on the recording target medium P, a variety of types of information is recorded on the recording target medium P.

Here, in each of the inkjet heads 5, when the jet of the ink from the jet hole 76 is started by the application of the drive voltage to the drive actuator 48, application of the drive voltage to the flow channel operating actuator 49 is started immediately after starting the jet of the ink, and thus, the ink column (the liquid column) to be formed in the back part of the ink to be jetted from the jet hole 76 is cut off.

Figure 7:
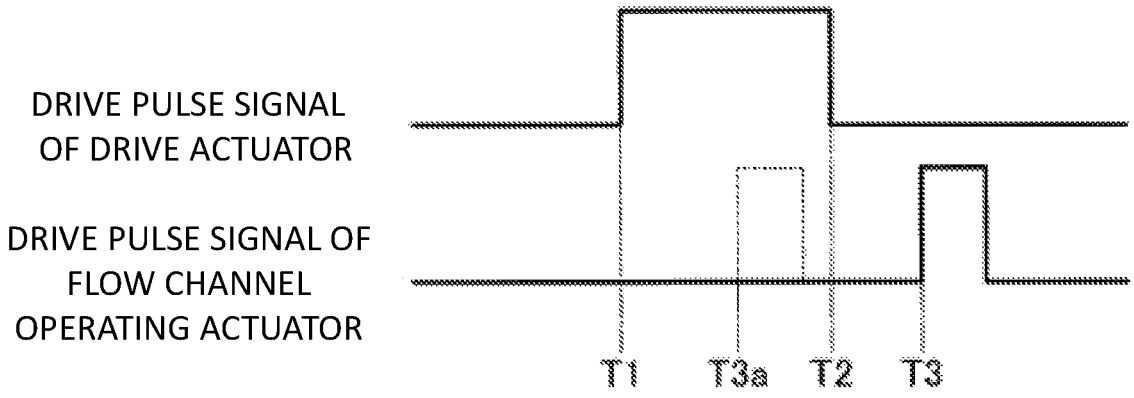
FIG. 7 is a diagram showing output timing of a drive voltage pulse of a drive actuator and a flow channel operating actuator of the liquid jet head (the inkjet head) according to the embodiment.

FIG. 7 is a diagram showing output timing of the drive voltage pulses of the drive actuator 48 and the flow channel operating actuator 49. In FIG. 7, T1 denotes the time when the drive voltage rises, and thus the ejection channel 55 of the drive actuator 48 starts the expansion of the capacity (filling of the ink starts), T2 denotes the time when the drive voltage falls, and the ejection channel 55 of the drive actuator 48 starts the contraction of the capacity (starts the extrusion of the ink). Further, T3 denotes the time when the flow channel operating actuator 49 starts driving.

As shown in FIG. 7, in the inkjet heads 5 according to the present embodiment, the flow channel operating actuator 49 starts driving after minute time has elapsed after the capacity of the ejection channel 55 of the drive actuator 48 contracts to start the extrusion. The start of the drive of the flow channel operating actuator 49 is arranged to be executed based on the control by the control section 34 at the timing when the ink starts to bulge from the jet hole 76 of the nozzle plate 54 due to the drive of the drive actuator 48.

It should be noted that in the present embodiment, the capacity of the ejection channel 55 is expanded at the timing of T1, and then the capacity of the ejection channel 55 is restored to the initial state at the timing of T2 to thereby perform the extrusion of the ink, but it is also possible to contract the capacity of the ejection channel 55 at the timing of T1 to start the extrusion of the ink, and then restore the capacity of the ejection channel 55 to the initial state at the timing of T2. In this case, the time when the flow channel operating actuator 49 starts driving is as indicated by T3*a* in FIG. 7.

FIGS. 8A through 8D are image diagrams each corresponding to the VIII-VIII cross-section in FIG. 3 sequentially showing the condition of the ink jetting using the inkjet head 5.

The details of the cutting off of the ink column Ia by the flow channel operating actuator 49 will hereinafter be described with reference to FIG. 7, and FIGS. 8A through 8D.

Figures 8A, 8B, 8C, 8D:
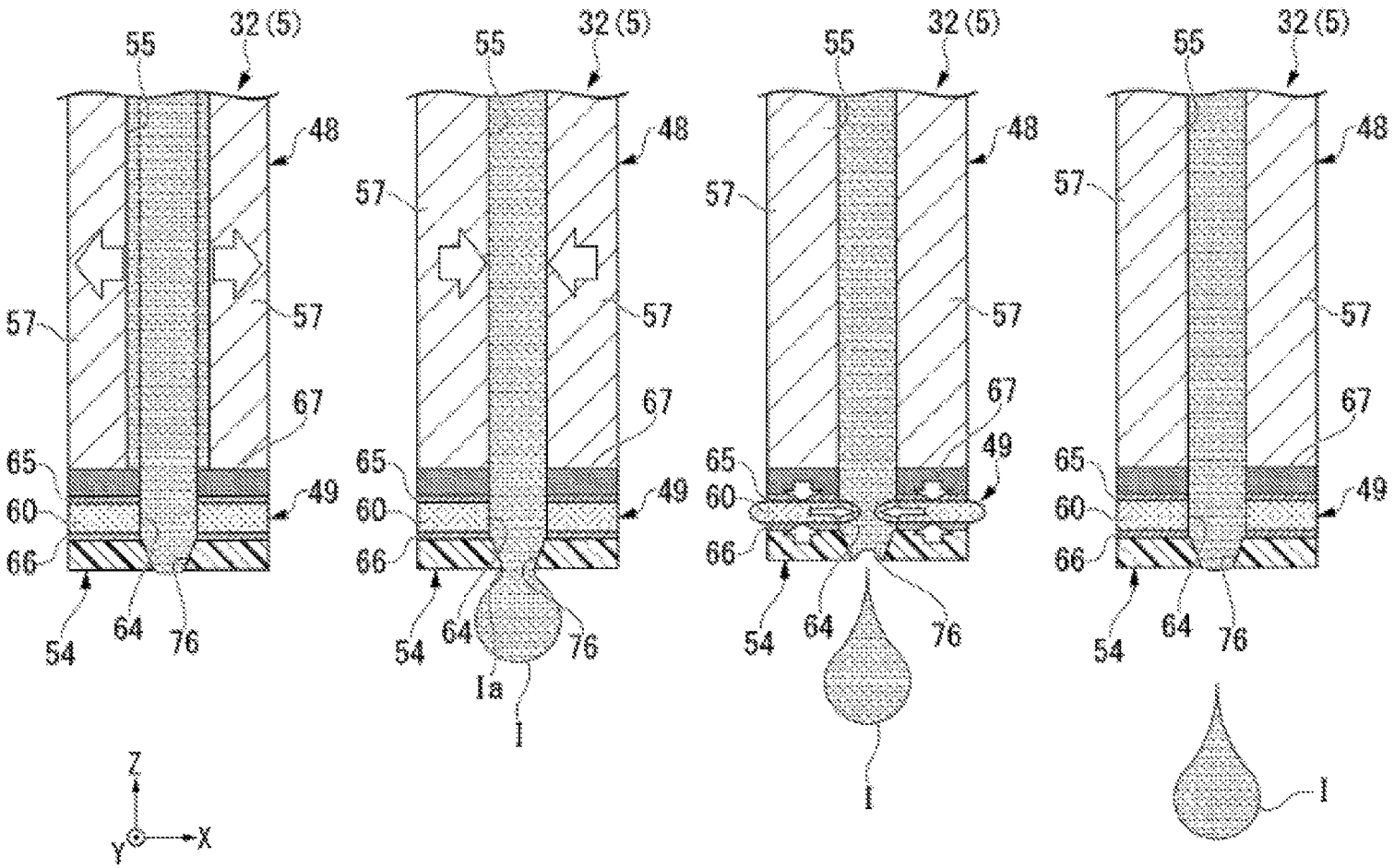
FIGS. 8A through 8D are image diagrams each corresponding to the VIII-VIII cross-section in FIG. 3 sequentially showing the condition of the ink jetting using the liquid jet head (the inkjet head) according to the embodiment.

At the timing of T1 shown in FIG. 7, the capacity of the ejection channel 55 of the drive actuator 48 is expanded as shown in FIG. 8A, and the ink is made to fill the ejection channel 55.

At the timing of T2 in FIG. 7, the capacity of the ejection channel 55 of the drive actuator 48 is restored to the initial state as shown in FIG. 8B, and at this moment, the ink in the ejection channel 55 is fed to the jet hole 76 of the nozzle plate 54 through the communication hole 64 of the flow channel operating actuator 49.

At the timing of T3 in FIG. 7, the droplet I of the ink bulges outside the jet hole 76 to start forming the ink column Ia in the back part of the droplet I. At this moment, drive of the flow channel operating actuator 49 is started as shown in FIG. 8C, and for example, the peripheral edge part of the communication hole 64 of the second actuator plate 60 deforms so as to be compressed in the thickness direction (the Z direction) while a part of the second actuator plate 60 of the flow channel operating actuator 49 deforms so as to bulge toward the center of the communication hole 64. In other words, the peripheral edge part of the communication hole 64 of the second actuator plate 60 is displaced in the direction substantially perpendicular to the axial direction of the communication hole 64, and in the direction along the axial direction of the communication hole 64. Further, the peripheral edge section of the jet hole 76 of the nozzle plate 54 bonded to the second actuator plate 60 is displaced in accordance with the peripheral edge part of the communication hole 64.

As a result, the ink column Ia in the back part of the ink droplet I is cut off by the second actuator plate 60 in an early stage as shown in FIG. 8C. Subsequently, as shown in FIG. 8D, the drive of the flow channel operating actuator 49 is released.

As described hereinabove, in the inkjet head 5 related to the present embodiment, the flow channel operating actuator 49 is disposed between the drive actuator 48 and the nozzle plate 54 to thereby make the flow channel operating actuator 49 capable of performing the displacing operation of the peripheral edge part of the communication hole 64 for communicating the drive actuator 48 and the jet hole 76 with each other. Therefore, by the flow channel operating actuator 49 performing the displacing operation on the peripheral edge part of the communication hole 64 after the drive actuator 48 provide the ink with the fluid pressure variation, it is possible to cut off the back part of the ink column Ia by the flow channel operating actuator 49 before the ink jetted from the jet hole 76 forms the long ink column Ia between the inside of the jet hole 76 and the ink. Therefore, it is possible to prevent the ink jetted from the jet hole 76 from forming the satellite droplet to thereby prevent the nozzle plate 54 from getting dirty with the scattering of the satellite droplet, and the print quality of the recording target medium P from deteriorating.

Further, since the inkjet head 5 according to the present embodiment is provided with the flow channel operating actuator 49 disposed on the inner side of the jet hole 76 of the nozzle plate 54, it is possible to easily and surely wipe the outer peripheral edge part of the jet hole 76 with a blade or the like during maintenance. Therefore, in the case of adopting the inkjet head 5 according to the present embodiment, it is possible to form an appropriate meniscus in the jet hole 76 by the maintenance with the blade or the like.

Therefore, by adopting the inkjet head 5 according to the present embodiment, it is possible to appropriately cut off the ink column formed immediately after jetted from the jet hole 76 to thereby prevent the satellite droplet from occurring, and moreover, it is possible to achieve easier maintenance of the jet hole 76 part.

Further, in the inkjet head 5 according to the present embodiment, the flow channel operating actuator 49 is configured so as to be able to perform the displacing operation on the inner peripheral edge part of the communication hole 64 in the direction substantially perpendicular to the axial direction of the communication hole 64. Therefore, by narrowing the inner diameter of the communication hole 64 using the flow channel operating actuator 49 when the ink is jetted from the jet hole 76 and the formation of the ink column Ia is starting, it is possible to cut off the back part of the ink column Ia by the movement of the communication hole 64.

Further, in the inkjet head 5 according to the present embodiment, the flow channel operating actuator 49 is configured so as to be able to perform the displacing operation on the outer peripheral edge part of the communication hole 64 in the direction along the axial direction of the communication hole 64. Therefore, by displacing the peripheral edge part of the communication hole 64 in a direction opposite to the jet direction of the ink using the flow channel operating actuator 49 when the ink is jetted from the jet hole 76 and the formation of the ink column Ia is starting, it is possible to cut off the back part of the ink column Ia by the movement of the communication hole 64.

In particular in the present embodiment, since it is possible to displace the peripheral edge part of the communication hole 64 in the direction along the axial direction of the communication hole 64 and the direction substantially perpendicular to the axial direction by the flow channel operating actuator 49 when the ink is jetted from the jet hole 76 and the formation of the ink column Ia is starting, it is possible to more surely cut off the back part of the ink column Ia.

Further, in the inkjet head 5 according to the present embodiment, the nozzle plate 54 is bonded to the flow channel operating actuator 49 so that the peripheral edge part of the jet hole 76 follows the displacement of the peripheral edge part of the communication hole 64. Therefore, when the peripheral edge part of the communication hole 64 is displaced due to the drive by the flow channel operating actuator 49, the peripheral edge part of the jet hole 76 of the nozzle plate 54 is similarly displaced following the displacement. Therefore, in the case of adopting the inkjet head 5 according to the present embodiment, it is possible to surely cut off the back part of the ink column Ia by the displacement of the peripheral edge part of the jet hole 76 of the nozzle plate 54 in the early stage of the formation of the ink column Ia by the ink having been jetted from the jet hole 76.

Further, in the inkjet head 5 according to the present embodiment, since the control section 34 controls the drive of the flow channel operating actuator 49 at the timing when the ink bulges from the jet hole 76 of the nozzle plate 54 due to the drive of the drive actuator 48, it is possible to appropriately cut off the back part of the ink column Ia in the early stage of the formation of the ink column Ia by the ink having been jetted from the jet hole 76.

Further, in the present embodiment, in the flow channel operating actuator 49, the electrodes 66, 65 are bonded to the both surfaces of the second actuator plate 60 made of a plate-shaped piezoelectric material, and the communication hole 64 is provided to the second actuator plate 60 so as to penetrate the second actuator plate 60 in the plate thickness direction. Therefore, it is possible to form the flow channel operating actuator 49 to be thin in wall thickness. Therefore, in the case of adopting this configuration, it is possible to dispose the flow channel operating actuator 49 compactly between the drive actuator plate 48 and the nozzle plate 54, and it is possible to achieve miniaturization of the inkjet head 5.

Further, since the inkjet printer 1 according to the present embodiment is equipped with the inkjet heads 5 described above, it is possible to jet the ink to the recording target medium P with good quality to perform printing, and at the same time easily perform the maintenance around the inkjet head 5.

Figure 9:
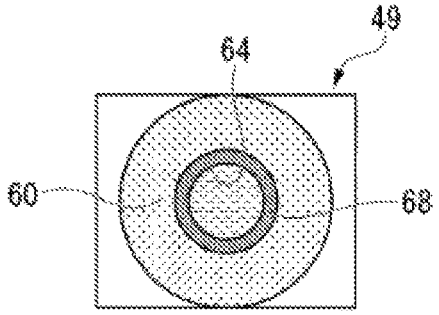
FIG. 9 is a cross-sectional view similar to FIG. 5 of another modified example of the liquid jet head (the inkjet head) according to the embodiment.

FIG. 9 is a similar cross-sectional view to FIG. 5 of another modified example of the embodiment described above.

Figure 10:
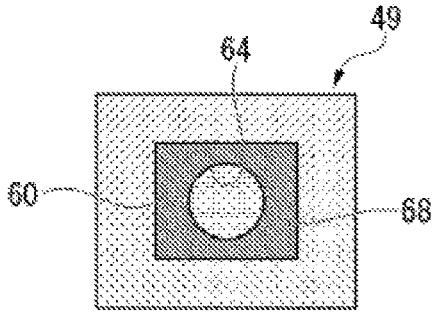
FIG. 10 is a cross-sectional view similar to FIG. 5 of still another modified example of the liquid jet head (the inkjet head) according to the embodiment.

In the embodiment described above, the communication hole 64 is directly provided to the second actuator plate 60. However it is also possible to form the second actuator plate 60 to have an annular shape viewed from the Z direction, dispose a protective film 68 having an insulating property made of $SiO_2$, parylene, or the like in the inner peripheral part of the second actuator plate 60, and form the communication hole 64 in the protective film 68 as shown in FIG. 9. In this case, the shape viewed from the Z direction of the second actuator plate 60 can be a circular ring-like shape as shown in FIG. 9, or can also be a rectangular ring-like shape as shown in FIG. 10.

Here, in the embodiment described above, it is arranged that the entire area of the peripheral edge part of the communication hole 64 of each of the flow channel operating actuators 49 is evenly displaced at the same timing. However, it is also possible to arrange that it is possible to partially displace a part of the peripheral edge part of the communication hole of each of the flow channel operating actuator.

Figure 11:
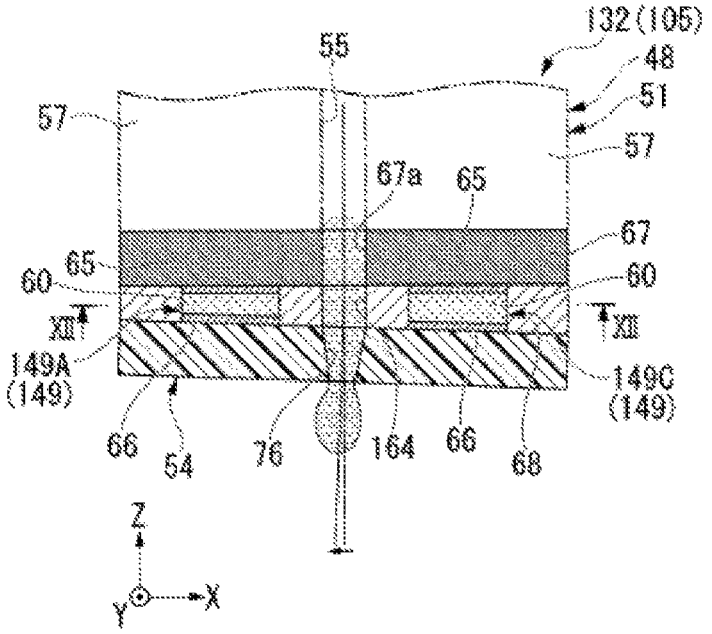
FIG. 11 is a cross-sectional view of a head chip to be mounted on a liquid jet head (an inkjet head) according to another embodiment.
Figure 12:
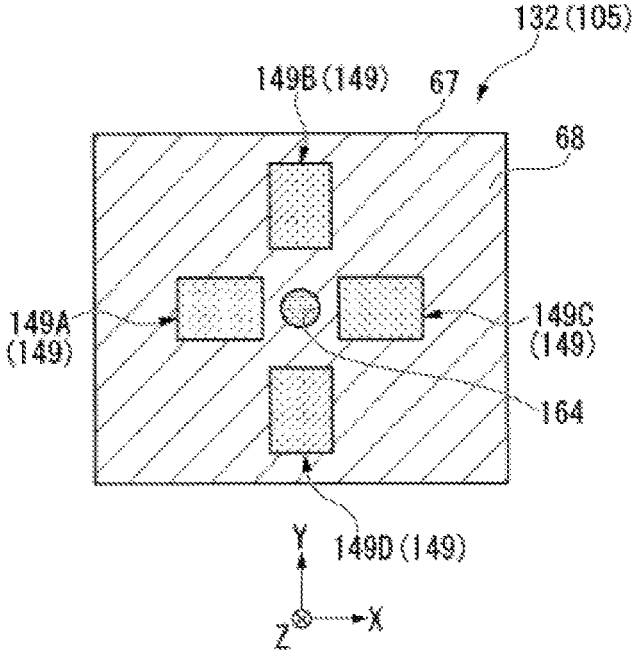
FIG. 12 is a cross-sectional view along the XII-XII line in FIG. 11 of the head chip to be mounted on the liquid jet head (the inkjet head) according to the other embodiment.

FIG. 11 is a cross-sectional view of a head chip 132 of an inkjet head 105 according to another embodiment being cut similarly to FIG. 3, and FIG. 12 is a cross-sectional view along the XII-XII line in FIG. 11 of the head chip 132. The head chip 132 shown in FIG. 11 and FIG. 12 will hereinafter be described. In the following description, the common parts to the embodiment described above are denoted by the same reference symbols, and redundant descriptions will be omitted.

The head chip 132 of the other embodiment is attached with an insulating plate 67 having an opening 67*a* communicated with the ejection channel 55 of the actuator plate 51 in the −Z direction end part of the first actuator plate 51. Further, on the −Z direction end surface of the insulating plate 67, there is attached a flow channel operating actuator 149 constituted by four actuator blocks 149A, 149B, 149C, 149D each having a rectangular shape. The four actuator blocks 149A, 149B, 149C, 149D are disposed at the respective positions centered on the central part of the opening 67*a* of the insulating plate 67 and shifted by 90° from one another. Further, the peripheral area of the four actuator blocks 149A, 149B, 149C, 149D along the X-Y plane is covered with the protective film 68 having an insulating property made of $SiO_2$, parylene, or the like. At the central position of the four actuator blocks 149A, 149B, 149C, 149D of the protective film 68, there is formed a communication hole 164 (a communication section) of the flow channel operating actuator 149 for communicating the drive actuator 48 and the jet hole 76 with each other.

On the −Z direction end surfaces of the four actuator blocks 149A, 149B, 149C, 149D of the flow channel operating actuator 149, there is bonded the nozzle plate 54 having the jet hole 76.

It is possible for the head chip 132 (the inkjet head 105) according to the present embodiment to drive all of the actuator blocks 149A, 149B, 149C, 149D of the flow channel operating actuator 149 at the same time immediately after starting the drive of the drive actuator 48 to evenly displace almost the entire area of the peripheral edge part of the communication hole 164 to thereby cut off the back part of the ink column similarly to the embodiment described above.

Further, besides the above, it is also possible for the head chip 132 (the inkjet head 105) according to the present embodiment to drive an arbitrary actuator block (e.g., 149A) to displace only a part of the peripheral edge part of the communication hole 164 immediately after starting the drive of the drive actuator 48 to thereby change the jet direction of the ink jetted from the jet hole 76 as shown in FIG. 7. Specifically, in the head chip 132 (inkjet head 105) according to the present embodiment, when driving an arbitrary actuator block (e.g., 149A) to displace only a part of the peripheral edge part of the communication hole 164, the peripheral edge part of the jet hole 76 of the nozzle plate 54 is tilted in accordance with the displacement, and as a result, the jet direction of the ink from the jet hole 76 is changed.

Figure 13:
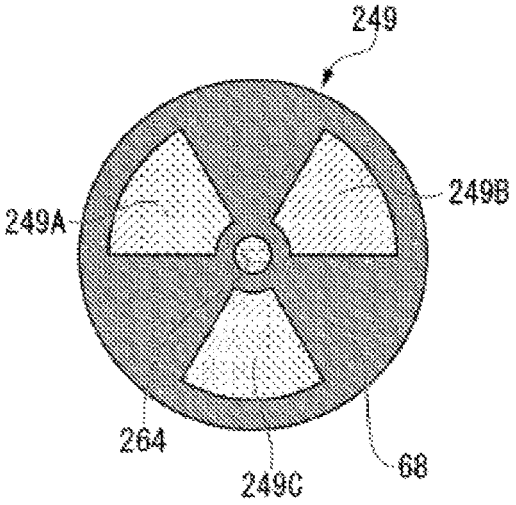
FIG. 13 is a cross-sectional view similar to FIG. 12 of a modified example of the liquid jet head (the inkjet head) according to the other embodiment.

FIG. 13 is a similar cross-sectional view to FIG. 12 of a modified example of the embodiment. Although in the embodiment described above, the flow channel operating actuator 149 is constituted by the four rectangular actuator blocks 149A, 149B, 149C, 149D, it is also possible to dispose a plurality of (e.g., three) substantially sectoral-shaped actuator blocks 249A, 249B, 249C to form an annular shape, cover the peripheral area of these actuator blocks 249A, 249B, 249C with the protective film 68 to thereby form a communication hole 264 in the protective film 68 as a flow channel operating actuator 249 shown in FIG. 14.

Figure 14:
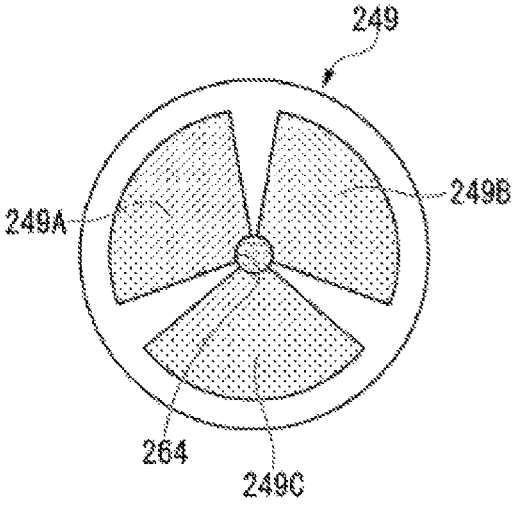
FIG. 14 is a cross-sectional view similar to FIG. 12 of another modified example of the liquid jet head (the inkjet head) according to the other embodiment.

Further, in the case in which the gaps between the actuator blocks 249A, 249B, 249C adjacent to each other are narrow, it is also possible to eliminate the protective film to form the communication hole 264 with inner peripheral surfaces of the actuator blocks 249A, 249B, 249C as shown in FIG. 14.

It should be noted that the invention is not limited to the embodiments described above, but can be provided with a variety of design changes within the scope or the spirit of the invention. For example, although in the embodiments described above, the drive actuator 48 for providing the fluid pressure variation to the ink in accordance with the drive voltage is formed of an actuator of the so-called edge shoot type for ejecting the ink from the end part in the extending direction of the ejection channel 55, the drive actuator is not limited to this type. The drive actuator can also be a type of, for example, disposing a vibrating plate in the upper part of the pressure chamber, and vibrating the vibrating plate using a piezoelectric element. Further, the drive actuator can also be a type of jetting the droplet using heat.

What is claimed is:

1. A liquid jet head comprising:

a drive actuator adapted to apply a pressure variation to a liquid filled therein;

a jet hole plate disposed on a downstream side of the drive actuator and adapted to jet the liquid having flown out from the drive actuator from a jet hole to an outside of the drive actuator; and a flow channel operating actuator disposed between the drive actuator and the jet hole plate, provided with a communication section adapted to communicate the drive actuator and the jet hole with each other, and configured to perform a displacing operation on at least a part of a peripheral edge part of the communication section.

2. The liquid jet head according to claim 1, wherein the flow channel operating actuator is configured to perform a displacing operation on the peripheral edge part of the communication section in a direction substantially perpendicular to an axial direction toward the jet hole of the communication section.

3. The liquid jet head according to claim 1, wherein the flow channel operating actuator is configured to perform a displacing operation on the peripheral edge part of the communication section in a direction along an axial direction toward the jet hole of the communication section.

4. The liquid jet head according to claim 1, wherein the jet hole plate is bonded to the flow channel operating actuator so that a peripheral edge part of the jet hole follows a displacement of the peripheral edge part of the communication section.

5. The liquid jet head according to claim 1, further comprising:

a control section adapted to control drive of the drive actuator and the flow channel operating actuator, wherein the control section drives the flow channel operating actuator at a timing when the liquid bulges from the jet hole of the jet hole plate due to the drive of the drive actuator.

6. The liquid jet head according to claim 1, wherein the flow channel operating actuator is configured by bonding electrodes opposite to each other to both sides of a plate-shaped piezoelectric material, and the communication section is formed so as to penetrate the piezoelectric material in a plate thickness direction.

7. A liquid jet recording device comprising:

the liquid jet head according to claim 1.

* * * * *